US009803852B1

(12) United States Patent
Clacken

(10) Patent No.: US 9,803,852 B1
(45) Date of Patent: Oct. 31, 2017

(54) ILLUMINATED HEADSET

(71) Applicant: Kevin Clacken, Paterson, NJ (US)

(72) Inventor: Kevin Clacken, Paterson, NJ (US)

( * ) Notice: Subject to any disclaimer, the term of this patent is extended or adjusted under 35 U.S.C. 154(b) by 211 days.

(21) Appl. No.: 14/962,041

(22) Filed: Dec. 8, 2015

(51) Int. Cl.

| | |
|---|---|
| ***F21V 9/16*** | (2006.01) |
| ***F21V 33/00*** | (2006.01) |
| ***H04R 1/10*** | (2006.01) |
| ***F21S 4/00*** | (2016.01) |
| ***F21K 99/00*** | (2016.01) |
| ***H04R 1/02*** | (2006.01) |
| *F21Y 103/00* | (2016.01) |

(52) U.S. Cl.
CPC ..... *F21V 33/0056* (2013.01); *F21K 9/56* (2013.01); *F21S 4/007* (2013.01); *H04R 1/028* (2013.01); *H04R 1/1008* (2013.01); *H04R 1/1041* (2013.01); *H04R 1/1058* (2013.01); *F21Y 2103/003* (2013.01)

(58) Field of Classification Search
CPC ..... F21V 33/0056; F21S 4/007; F21K 9/56; H04R 1/1008; H04R 1/1058; H04R 1/028; H04R 1/1041; F21Y 2103/003
See application file for complete search history.

(56) References Cited

U.S. PATENT DOCUMENTS

| | | | | |
|---|---|---|---|---|
| 4,920,466 | A | 4/1990 | Liu | |
| 6,787,990 | B2 * | 9/2004 | Cok | H01R 12/7076 313/499 |
| 6,945,663 | B2 * | 9/2005 | Chien | A43B 3/0005 362/108 |
| 7,114,823 | B2 | 10/2006 | McCullough | |
| 7,318,654 | B2 | 1/2008 | McClanahan | |
| 7,319,762 | B2 | 1/2008 | Andrea | |
| D662,079 | S | 6/2012 | Fahrendorff | |
| 8,210,713 | B1 | 7/2012 | Witt | |
| 2002/0027777 | A1 | 3/2002 | Takasu | |
| 2005/0175210 | A1 | 8/2005 | Yang | |
| 2007/0019821 | A1 | 1/2007 | Dudley | |
| 2007/0047740 | A1 * | 3/2007 | Andrea | H04R 1/1041 381/74 |
| 2014/0211457 | A1 * | 7/2014 | Tarsa | F21S 8/06 362/147 |
| 2015/0071456 | A1 * | 3/2015 | Steenkamp | H04R 1/1008 381/74 |
| 2016/0100238 | A1 * | 4/2016 | Broadley | H04R 1/1066 381/371 |
| 2016/0170119 | A1 * | 6/2016 | Hao | A42B 3/044 362/565 |

* cited by examiner

*Primary Examiner* — Ali Alavi
(74) *Attorney, Agent, or Firm* — Kyle A. Fletcher, Esq.

(57) ABSTRACT

The illuminated headset is a headphone that is adapted for listening to audio sources, which provide electrical signals, which are converted to audible sound by the speakers in the headphone. The headphone is enhanced with an illumination system. The illumination system comprises a plurality of LEDs and a phosphorescent material. The plurality of LEDs is used to illuminate the cable, the left speaker, and the right speaker. The phosphorescent material is used to form the headband, the left speaker housing, and the right speaker housing. The illuminated headset comprises a headset, a master cable, a jack, a clasp, a left cable, and a right cable.

20 Claims, 6 Drawing Sheets

ILLUMINATED HEADSET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of electro-audio acoustic transducers, more specifically, a headset.

SUMMARY OF INVENTION

The illuminated headset is a headphone that is adapted for listening to audio sources, which provide electrical signals which are converted to audible sound by the speakers in the headphone. The headphone is enhanced with an illumination system. The illumination system comprises a plurality of LEDs and a phosphorescent material. The plurality of LEDs is used to illuminate the cable, the left speaker, and the right speaker. The phosphorescent material is used to form the headband, the left speaker housing, and the right speaker housing.

These together with additional objects, features and advantages of the illuminated headset will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated headset in detail, it is to be understood that the illuminated headset is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated headset.

It is therefore important that the claims be regarded as including such equivalent construction insofar as they do not depart from the spirit and scope of the illuminated headset. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
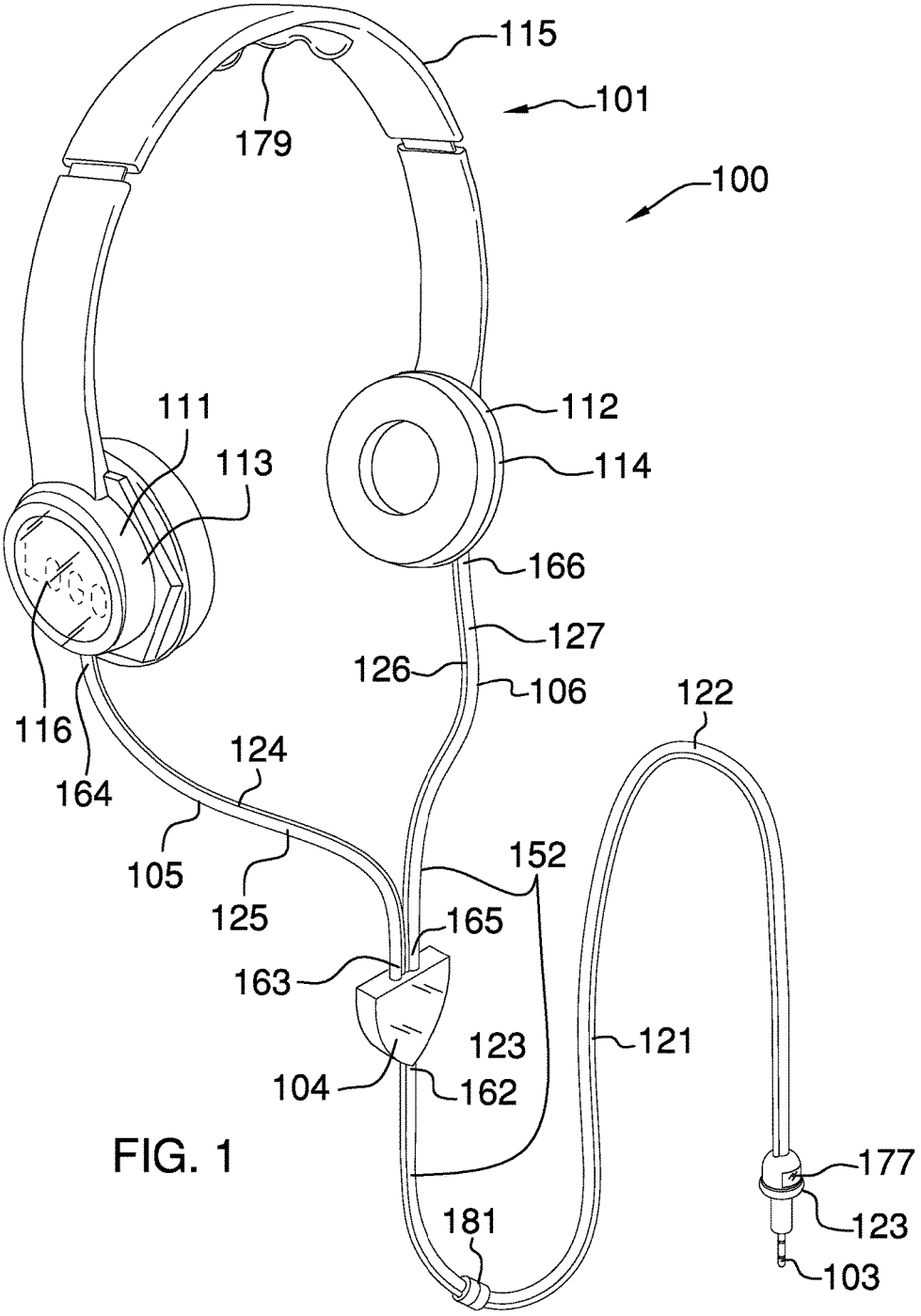
FIG. 1 is a perspective view of an embodiment of the disclosure.
Figure 2:
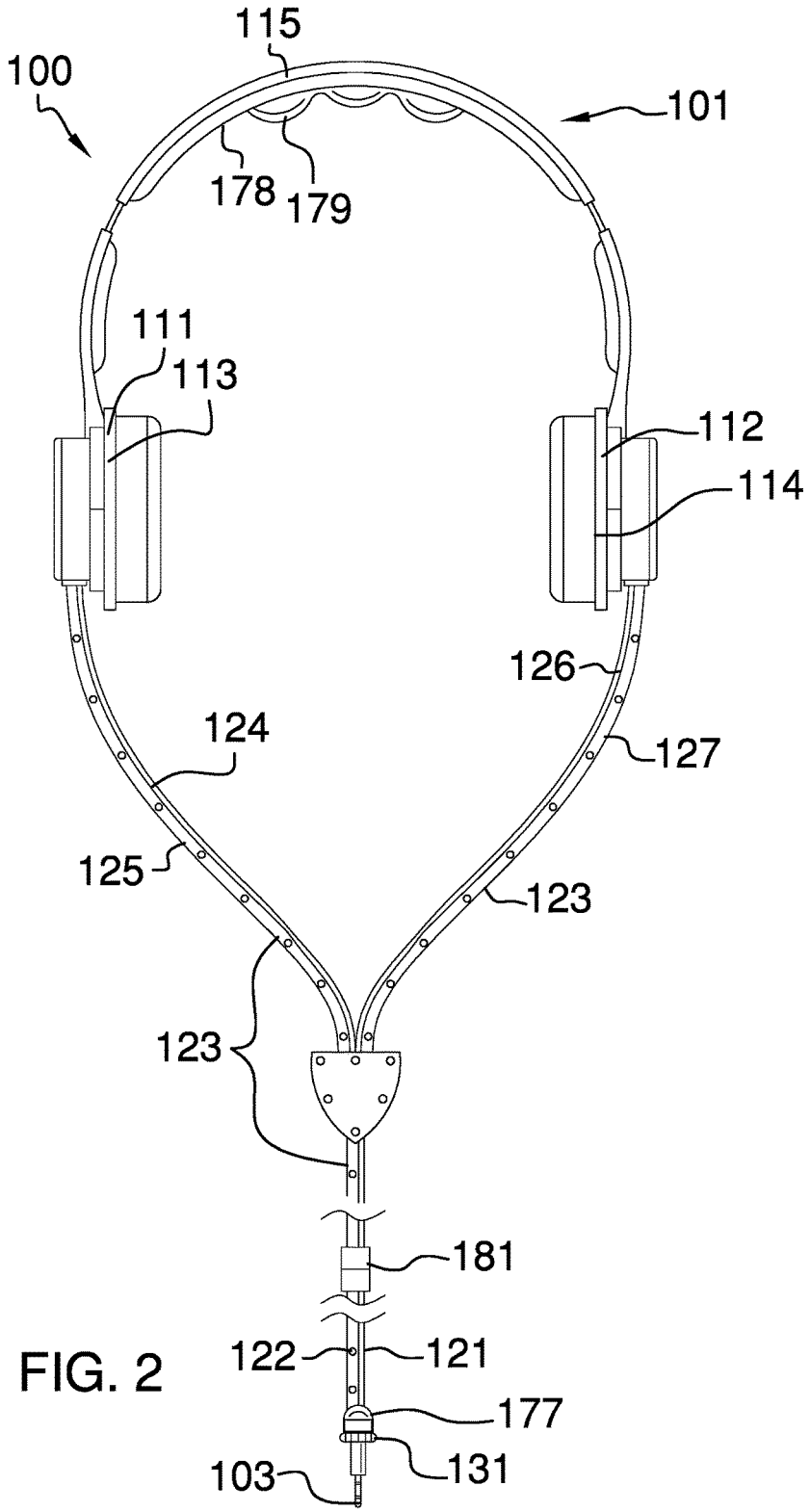
FIG. 2 is a front view of an embodiment of the disclosure.
Figure 3:
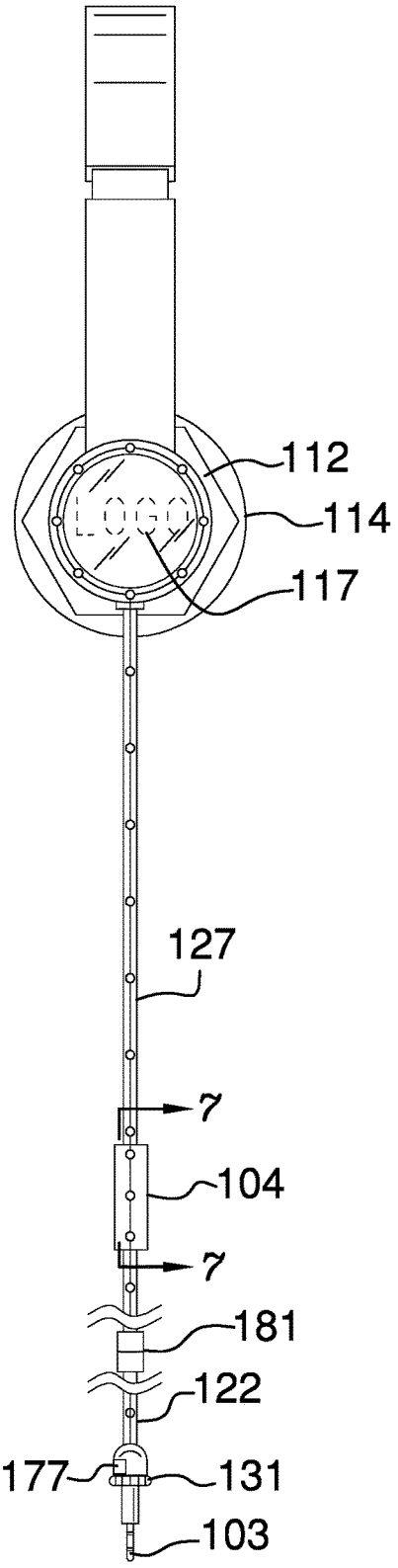
FIG. 3 is a side view of an embodiment of the disclosure.
Figure 5:
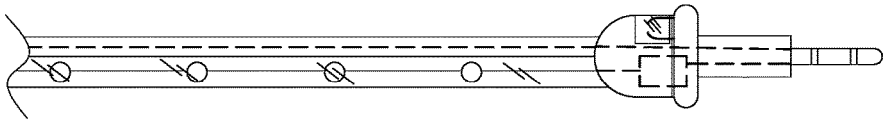
FIG. 5 is a detail view of an embodiment of the disclosure.
Figure 4:
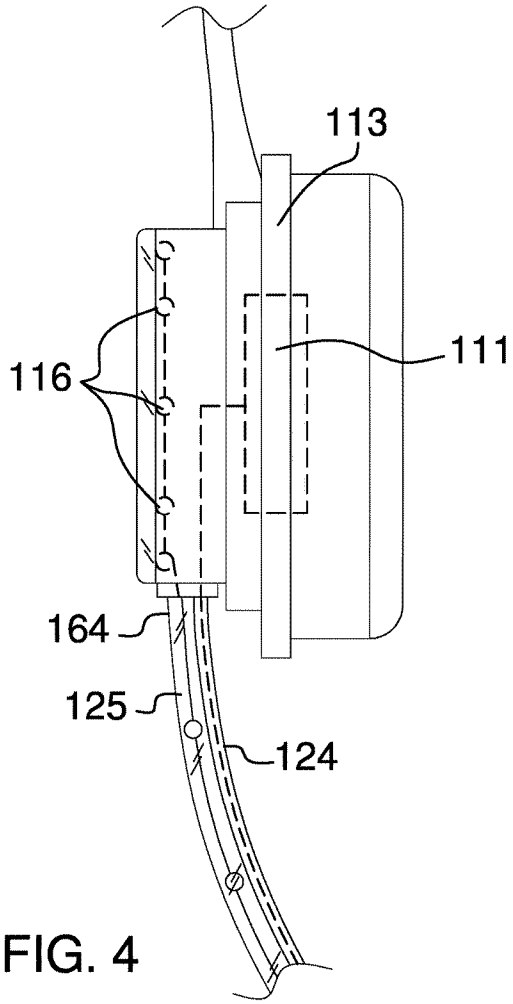
FIG. 4 is a detail view of an embodiment of the disclosure.
Figure 6:
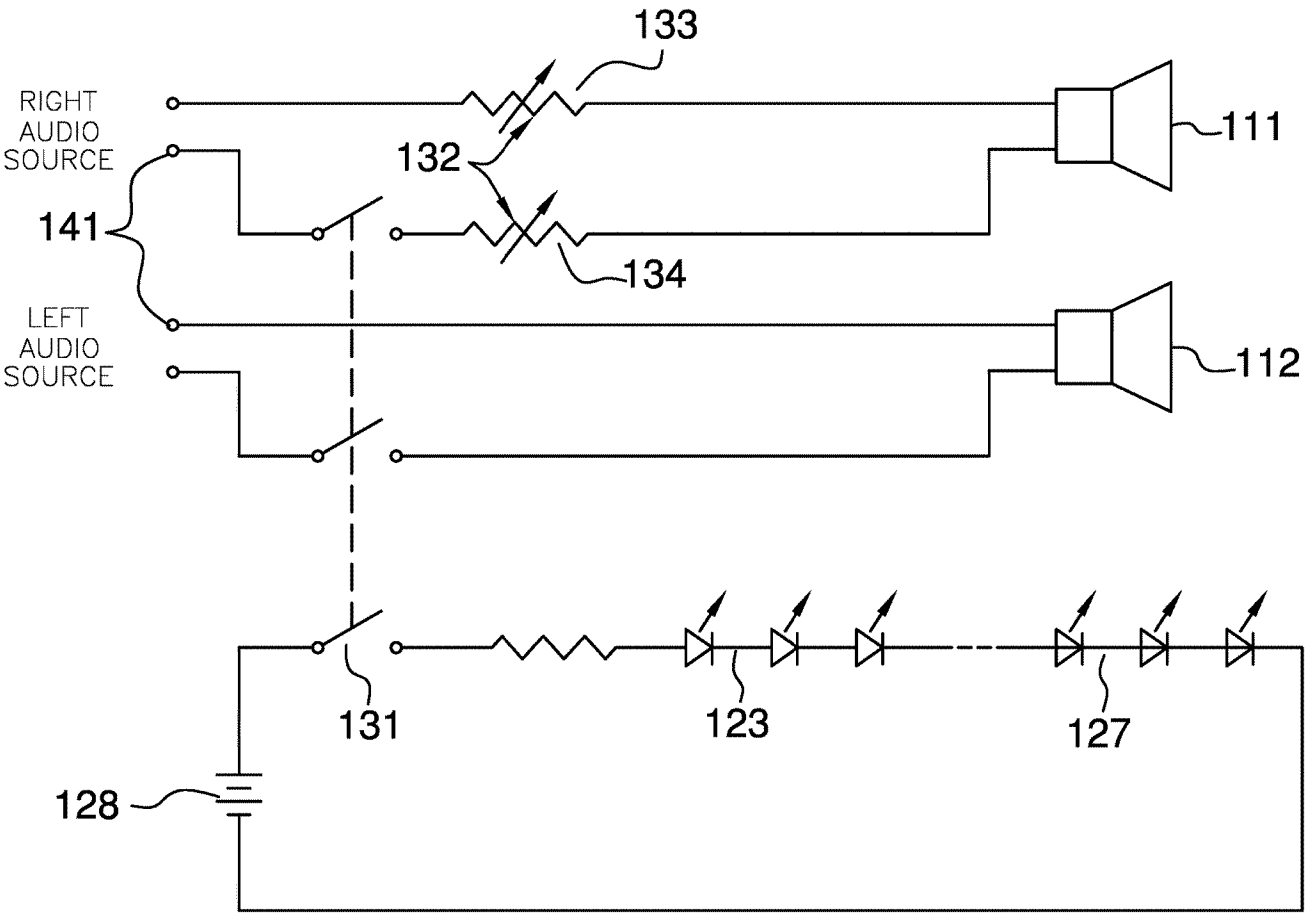
FIG. 6 is a schematic of an embodiment of the disclosure.
Figure 7:
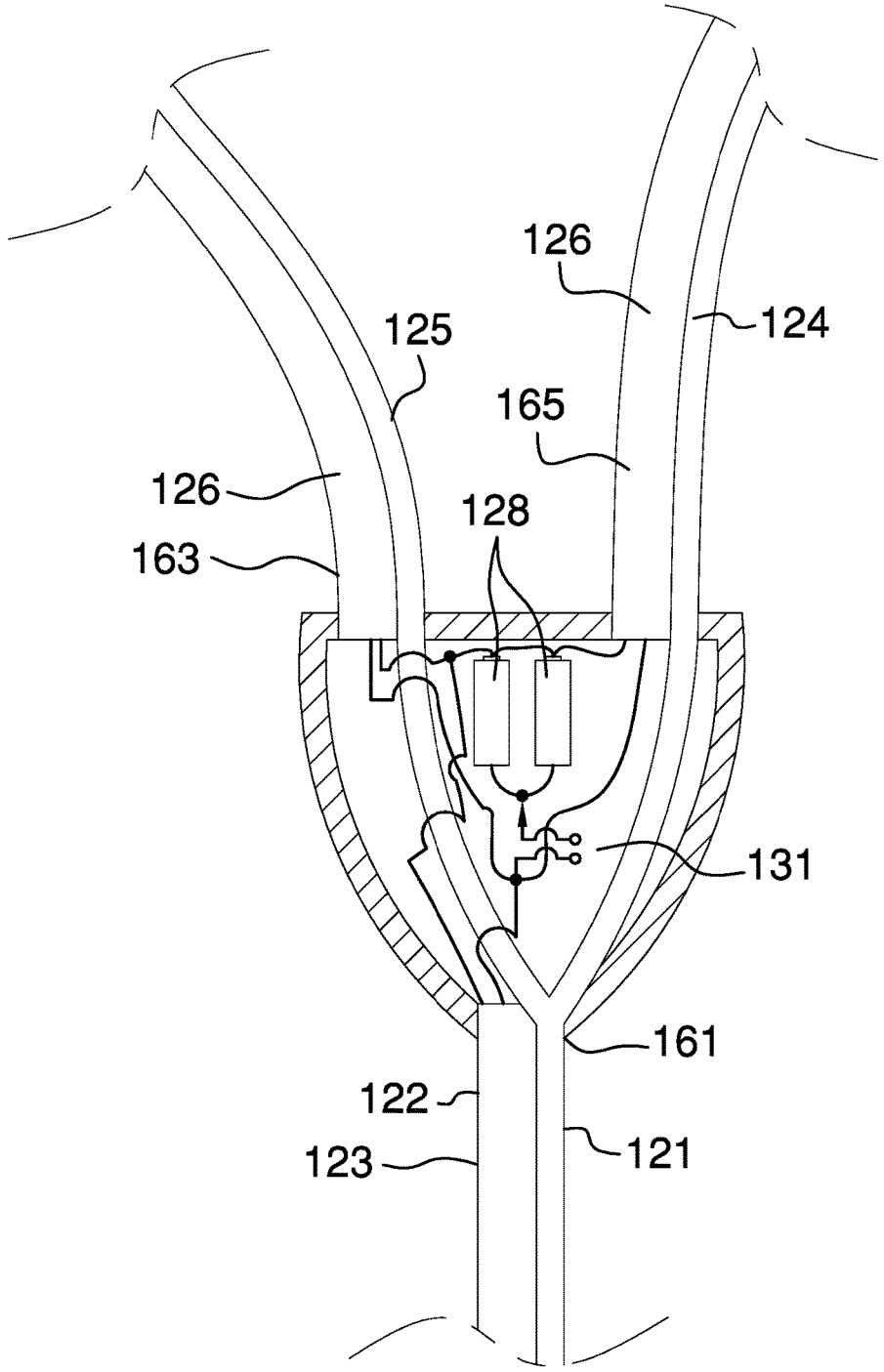
FIG. 7 is a cross-sectional view of an embodiment of the disclosure across 7-7 in FIG. 3.

Detailed reference will now be made to a first potential embodiment of the disclosure, which is illustrated in FIGS. 1 through 7. The illuminated headset 100 (hereinafter invention) comprises a headset 101, a master cable 102, a jack 103, a clasp 104, a left cable 105, and a right cable 106.

The headset 101 further comprises a left speaker housing 113, a right speaker housing 114, and a headband 115. The left speaker housing 113, right speaker housing 114, and headband 115 are made of plastic that has incorporated in it a phosphorescent material that allows the left speaker housing 113, right speaker housing 114, and headband 115 to "glow in the dark" by continuing to emit light, after the stimulating light has been discontinued. The phosphorescent material can be incorporated directly in the plastic while the left speaker housing 113, a right speaker housing 114, and a headband 115 are being molded, or the phosphorescent material can be applied after molding as a phosphorescent paint. The headband 115 may be further defined with an inner headband surface 178 that includes a plurality of finger indentations 179 thereon. The plurality of finger indentations 179 is used to aid in carrying the invention 100 when not being worn.

The left speaker housing 113 further comprises a left speaker 111 and a second plurality of LEDs 116. Both the left speaker 111 and the second plurality of LEDs 116 are mounted within the left speaker housing 113. The second plurality of LEDs 116 is mounted within the left speaker housing 113 such that each of the second plurality of LEDs 116 are visible when illuminated. Optionally, the second plurality of LEDs 116 can be arranged to form a logo.

The right speaker housing 114 further comprises a right speaker 112 and a third plurality of LEDs 117. Both the right speaker 112 and the third plurality of LEDs 117 are mounted within the right speaker housing 114. The third plurality of LEDs 117 is mounted within the right speaker housing 114 such that each of the third plurality of LEDs 117 are visible when illuminated. Optionally, the third plurality of LEDs 117 can be arranged to form a logo.

The master cable 102 further comprises a main audio cable 121 and a main LED cable 122. The main audio cable 121 is a cable that transmits the electrical signals from an audio source 141 to the left speaker 111 and the right speaker 112 of the headset 101. The main LED cable 122 is a commercially available LED lighting strip. The LED light strip comprises a first plurality of LEDs 123 that are surface mounted on a flexible strip. The master cable 102 is formed by attaching the main LED cable 122 to the main audio cable 121 using the adhesive backing supplied with the LED lighting strip to attach the main LED cable 122 to the main audio cable 121. The master cable 102 further comprises a first end 161 and a second end 162.

The left cable 105 further comprises a left audio cable 124 and a left LED cable 125. The left audio cable 124 is a cable that transmits the electrical signals from an audio source 141 to the left speaker 111 of the headset 101. The left LED cable 125 is a commercially available LED lighting strip. The LED light strip comprises a first plurality of LEDs 123 that are surface mounted on a flexible strip. The left cable 105 is formed by attaching the left LED cable 125 to the left audio cable 124 using the adhesive backing supplied with the LED lighting strip to attach the left LED cable 125 to the left audio cable 124. The left cable 105 further comprises a third end 163 and a fourth end 164. The left LED cable 125 is connected to the second plurality of LEDs 116.

The right cable 106 further comprises a right audio cable 126 and a right LED cable 127. The right audio cable 126 is a cable that transmits the electrical signals from an audio source 141 to the right speaker 112 of the headset 101. The right LED cable 127 is a commercially available LED lighting strip. The LED light strip comprises a first plurality of LEDs 123 that are surface mounted on a flexible strip. The right cable 106 is formed by attaching the right LED cable 127 to the right audio cable 126 using the adhesive backing supplied with the LED lighting strip to attach the right LED cable 127 to the right audio cable 126. The right cable 106 further comprises a fifth end 165 and a sixth end 166. The right LED cable 127 is connected to the third plurality of LEDs 117.

The main audio cable 121 is terminated with a jack 103 at the first end 161 of the master cable 102. The purpose of the jack 103 is to connect the invention 100 to an audio source 141. The jack 103 is a commercially available 3.5 mm audio jack. The jack 103 is also wired to contain the on off switch 131 and the volume control 132. The on off switch 131 is a commercially available single pole triple throw switch that is used to disconnect the main audio cable 121. The volume control 132 comprises a left variable resistor 133 and a right variable resistor 134 that are placed in series with the left speaker 111 and right speaker 112 respectively.

Located immediately adjacent to the on off switch 131 is a light member 177. The light member 177 is used to provide a visual indication as to the output of the on off switch 131 and the level of audio being dispensed via the volume control 132. Ideally, the light member 177 is a light emitting diode.

The second end 162 of the main cable 102, the third end 163 of the left cable 105, and the fifth end 165 of the right cable 106 are terminated at the clasp 104. The purpose of the clasp 104 is to split the main cable 102 in to the left cable 105 and the right cable 106 and to provide the electrical power necessary to operate the main LED cable 122, the left LED cable 125 and the right LED cable 127. As shown most clearly in FIG. 7, the clasp 104 contains one or more batteries 128. The purpose of the batteries is to power the main LED cable 122, the left LED cable 125, and the right LED cable 127. The main LED cable 122, the left LED cable 125, and the right LED cable 127 are terminated within the clasp 104 such that the main LED cable 122, the left LED cable 125, and the right LED cable 127 are connected to the battery in series with the on off switch 131. The main audio cable 121 wired into the clasp 104 such that the left speaker 111 signal generated by the audio source 141 is electrically terminated to the left audio cable 124 and the right speaker 112 signal generated by the audio source 141 is electrically terminated to the right audio cable 126.

In a second potential embodiment of the disclosure, the on off switch 131 and the volume control 132 are mounted in the clasp 104.

To use the invention 100, the headset 101 is left in light to activate the phosphorescent material. The lights are then turned off and the user puts on the headset 101. The user plugs the jack 103 into the audio source 141 and turns on the on off switch 131. At this point, sound generated from the audio source 141 can be heard through the left speaker 111 and the right speaker 112 and the LEDs contained within the invention 100 will be clearly visible.

Except for the clasp 104, all the components of the first potential embodiment of the disclosure and the second potential embodiment of the disclosure are commercially available. The clasp 104 can be molded from plastic. Suitable plastics include, but are not limited to polycarbonate and polyvinylchloride.

The invention 100 may optionally include a microphone 181. The microphone 181 is located in-line on the main audio cable 121.

The following definitions were used in this disclosure:

Audio Source: As used in this disclosure, an audio source is a device that generates electrical signals that can be converted in to audible sounds by a speaker.

Battery: As used in this disclosure, a battery is a container consisting of one or more cells, in which chemical energy is converted into electricity and used as a source of power.

Cable: As used in this disclosure, a cable is a collection of insulated wires covered by a protective casing that is used for transmitting electricity or telecommunication signals.

Jack: As used in this disclosure, a jack is a round pin that is plugged into a matching port in order to make and disconnect electrical connections.

LED: As used in this disclosure, an LED is an acronym for a light emitting diode. A light emitting diode is a 2 lead semiconductor that is also a light source.

Headphone: As used in this disclosure, a headphone is a device that comprises one or two earphones that are held to the ear, typically through the use of a band placed on top of the head. Headset is a synonym for headphone.

Phosphoresce: As used in this disclosure, to phosphoresce means to persist in emitting light, unaccompanied by sensible heat or combustion after exposure to and removal of stimulating radiation.

Phosphorescence: As used in this disclosure, phosphorescence is the light that is emitted from an object that is phosphorescing.

Phosphorescent: As used in this disclosure, phosphorescent is an adjective that is used to describe an object that exhibits or is capable of exhibiting phosphorescence.

Speaker: As used in this disclosure, the term a speaker is an electrical device that converts an electrical signal into an audible sound.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An audio device comprising:

a headset, a master cable, a jack, a clasp, a left cable, and a right cable;

wherein the audio device further comprises a plurality of LEDs;

wherein the jack further comprises devices that are used to control the audio device;

wherein the headset glows in the dark.

2. The audio device according to claim 1 wherein the headset further comprises a left speaker housing, a right speaker housing, and a headband.

3. The audio device according to claim 2 wherein the left speaker housing is made of plastic that has incorporated in it a phosphorescent material;

wherein the right speaker housing is made of plastic that has incorporated in it a phosphorescent material;

wherein the headband is made of plastic that has incorporated in it a phosphorescent material.

4. The audio device according to claim 3 wherein the left speaker housing further comprises a left speaker and a first plurality of LEDs;

wherein the right speaker housing further comprises a right speaker and a third plurality of LEDs.

5. The audio device according to claim 4 wherein the left speaker is mounted within the left speaker housing;

wherein the first plurality of LEDS are mounted within the left speaker housing such that each of the second plurality of LEDs are visible when illuminated;

wherein the right speaker is mounted within the right speaker housing;

wherein the second plurality of LEDS are mounted within the right speaker housing such that each of the second plurality of LEDs are visible when illuminated.

6. The audio device according to claim 5 wherein the master cable further comprises a main audio cable and a main LED cable;

wherein the main audio cable transmits electrical signals from an audio source to the left speaker and the right speaker of the headset.

7. The audio device according to claim 6 wherein the main LED cable further comprises is a first LED lighting strip;

wherein the first LED light strip comprises a third plurality of LEDs.

8. The audio device according to claim 7 wherein the master cable is formed by attaching the main LED cable to the main audio cable;

wherein the master cable further comprises a first end and a second end.

9. The audio device according to claim 8 wherein the left cable further comprises a left audio cable and a left LED cable;

wherein the left audio cable transmits electrical signals from an audio source to the left speaker of the headset.

10. The audio device according to claim 9 wherein the left LED cable further comprises is a second LED lighting strip;

wherein the second LED light strip comprises a fourth plurality of LEDs.

11. The audio device according to claim 10 wherein the left cable is formed by attaching the left LED cable to the main audio cable;

wherein the left cable further comprises a third end and a fourth end.

12. The audio device according to claim 11 wherein the right cable further comprises a right audio cable and a right LED cable;

wherein the right audio cable transmits electrical signals from an audio source to the right speaker of the headset.

13. The audio device according to claim 12 wherein the right LED cable further comprises is a third LED lighting strip;

wherein the third LED light strip comprises a fifth plurality of LEDs.

14. The audio device according to claim 13 wherein the right cable is formed by attaching right left LED cable to the right audio cable;

wherein the right cable further comprises a fifth end and a sixth end.

15. The audio device according to claim 14 wherein the first end of the main audio cable is terminated with a jack;

wherein the jack is wired to contain an on off switch and a volume control.

16. The audio device according to claim 15 wherein the second end of the main cable is terminated at the clasp;

wherein the third end of the left cable is terminated at the clasp;

wherein the fifth end of the right cable is terminated at the clasp.

17. The audio device according to claim 16 wherein the clasp splits the main audio cable in to the left audio cable and the right audio cable.

18. The audio device according to claim 17 wherein the provide the electrical power to the first plurality of LEDS, the second plurality of LEDs, the third plurality of LEDs, the fourth plurality of LEDs and the fifth plurality of LEDs.

19. The audio device according to claim 18 wherein the headband is further defined with an inner headband surface that includes a plurality of finger indentations thereon; wherein the plurality of finger indentations is used to aid in carrying the audio device when not being worn.

20. The audio device according to claim 19 wherein located immediately adjacent to the on off switch is a light member; wherein the light member is used to provide a visual indication as to the output of the on off switch and the level of audio being dispensed via the volume control; wherein a microphone is located in-line on the main audio cable.

* * * * *